US009923311B2

(12) United States Patent
Blakborn

(10) Patent No.: US 9,923,311 B2
(45) Date of Patent: Mar. 20, 2018

(54) SAFETY SYSTEM FOR HIGH CURRENT APPLICATIONS

(71) Applicant: ROSENBERGER HOCHFREQUENZTECHNIK GMBH & CO. KG, Fridolfing (DE)

(72) Inventor: Willem Blakborn, Inzell (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/388,423

(22) PCT Filed: Mar. 25, 2013

(86) PCT No.: PCT/EP2013/000900
§ 371 (c)(1),
(2) Date: Sep. 26, 2014

(87) PCT Pub. No.: WO2013/143682
PCT Pub. Date: Oct. 3, 2013

(65) Prior Publication Data

US 2015/0325961 A1 Nov. 12, 2015

(30) Foreign Application Priority Data

Mar. 28, 2012 (DE) ..... 20 2012 003 170 U

(51) Int. Cl.
*H01R 13/68* (2011.01)
*H01R 13/53* (2006.01)
(Continued)

(52) U.S. Cl.
CPC ..... *H01R 13/713* (2013.01); *H01H 71/10* (2013.01); *H01R 13/5219* (2013.01);
(Continued)

(58) Field of Classification Search
CPC .... H01R 13/68; H01R 13/53; H01R 13/6666; H01R 13/447
(Continued)

(56) References Cited

U.S. PATENT DOCUMENTS 2,008,050 A 7/1935 Tampier
3,742,414 A * 6/1973 Gittin ..... H01H 85/303 337/206
(Continued)

FOREIGN PATENT DOCUMENTS

DE 102006033323 A1 1/2008
EP 0821440 A1 1/1998
(Continued)

OTHER PUBLICATIONS

"IP Rating Chart", DSM&T, <http://www.dsmt.com/resources/ip-rating-chart>, published Nov. 3, 2012, accessed Sep. 16, 2015.*

*Primary Examiner* — Michael A Lyons
*Assistant Examiner* — Matthew T Dzierzynski
(74) *Attorney, Agent, or Firm* — DeLio, Peterson & Curcio LLC; Robert Curcio

(57) ABSTRACT

A safety system for high current applications, having a high current circuit breaker and a housing enclosing the high current circuit breaker. The housing forms a plug connector for electrical contact and mechanical connection to a mating plug connector, and the high current circuit breaker can also be accommodated in a permanently closed manner.

15 Claims, 6 Drawing Sheets

(51) Int. Cl.

| | |
|---|---|
| ***H01R 13/447*** | (2006.01) |
| ***H01R 13/713*** | (2006.01) |
| ***H01R 13/6581*** | (2011.01) |
| ***H01R 13/52*** | (2006.01) |
| ***H01H 71/10*** | (2006.01) |
| ***H01R 13/645*** | (2006.01) |

(52) U.S. Cl.
CPC ..... *H01R 13/53* (2013.01); *H01R 13/645* (2013.01); *H01R 13/6581* (2013.01); *H01R 2201/26* (2013.01)

(58) Field of Classification Search
USPC ..... 439/620.26, 607.41, 135, 489, 955, 439/620.41, 620.28, 620.34
See application file for complete search history.

(56) References Cited

U.S. PATENT DOCUMENTS

| | | | | |
|---|---|---|---|---|
| 4,759,730 | A * | 7/1988 | Sappington | H01H 85/201 337/198 |
| 5,316,502 | A | 5/1994 | Loet | |
| 7,500,865 | B2 * | 3/2009 | Natter | H01R 27/02 439/362 |
| 7,588,461 | B2 * | 9/2009 | Tyler | B60L 3/0069 439/607.41 |
| 7,985,098 | B2 * | 7/2011 | De Chazal | H01H 9/104 439/620.31 |
| 8,221,165 | B2 * | 7/2012 | DeWitte | B60L 11/1818 439/620.26 |
| 8,992,242 | B2 * | 3/2015 | Casses | H01R 13/5205 439/271 |
| 9,004,946 | B2 * | 4/2015 | Hoeppner | H01R 13/53 439/607.41 |
| 9,011,180 | B2 * | 4/2015 | Sharaf | H01R 13/684 439/620.3 |
| 2006/0286868 | A1 | 12/2006 | Pentell | |
| 2008/0050957 | A1 | 2/2008 | Natter et al. | |
| 2010/0124834 | A1 | 5/2010 | De Chazal | |

FOREIGN PATENT DOCUMENTS

| | | | |
|---|---|---|---|
| JP | 2004031349 | A | 1/2004 |
| JP | 2008027908 | A | 2/2008 |
| WO | 20080109109 | A1 | 9/2008 |
| WO | 2011077194 | A1 | 6/2011 |

* cited by examiner

SAFETY SYSTEM FOR HIGH CURRENT APPLICATIONS

BACKGROUND OF THE INVENTION

1. Field of the Invention

The invention relates to a safety system for high current applications, a plug connector system equipped with such a safety system and an electrical system equipped with such a plug connector system.

2. Description of Related Art

In motor vehicles with an electric-powered drivetrain, i.e., electric or hybrid vehicles, high levels of electric power need to be transmitted from an energy source (for example a battery unit) to a consumer (for example electric refrigerant compressors). In order to keep the losses which occur during transmission as low as possible, the electrical (high current) system comprising the battery unit and the electric drive motor is operated with a comparatively high voltage, which is in particular higher than 12 V, 24 V, or 48 V, at which the vehicle electrical system of conventional motor vehicles is operated.

In addition to this high current system, the known vehicles with electric-powered drivetrain also possess a conventional vehicle electrical system which—as in conventional motor vehicles—is based on an electrical voltage of 12 V, 24 V, or 48 V. On the one hand, this means that the same components can be used for the vehicle electrical systems of conventional vehicles and of vehicles with an electric-powered drivetrain, saving on development and manufacturing costs. On the other hand, maintenance and repair work can be carried out on the vehicle electrical system by "normal" workshops, since, because of the weak electrical voltage, even a mistake made during maintenance does not result in a hazard to the servicing personnel.

In contrast, due to the high voltage used, the high current system of electric or hybrid vehicles represents a considerable danger potential. In many cases, individual components or even whole units of the high current system therefore need to be designed so as to be inaccessible to servicing personnel. This is done, for example, in that the components or units of the high current system are built into housings which cannot be opened, or cannot be opened without being damaged. In the event of a defect in a component integrated into a housing, only the entire unit can therefore be replaced by the servicing personnel, which due to the electrical insulation of the housing can be done largely without any danger. However, it is clear that the replacement of functionally serviceable components which are integrated into a unit with a component which is no longer functionally serviceable involves considerable and in principle unnecessary costs.

As with virtually all electrical systems, circuit breakers are also integrated in the high current system of motor vehicles with electric-powered drivetrain which fail ("blow") in the event of a temporary unacceptably high current level, permanently interrupting the flow of current. As a result, the other high-quality components of the high current system are protected against damage.

In the present high current systems of motor vehicles with an electric-powered drivetrain, high current circuit breakers are regularly combined in a unit together with a plurality of other electrical components, wherein the components are protected against contact with servicing personnel through a housing which cannot be opened (without being damaged). However, this leads to the problem that if the high current circuit breaker "blows", which is its fundamental function, it is not possible simply to replace the high current circuit breaker; the entire unit has to be replaced. In many cases this leads to unacceptably high repair costs.

SUMMARY OF THE INVENTION

Starting out from this prior art, the invention was based on the problem of providing an improved possibility for protecting high current systems against overcurrent. In particular, a possibility was to be provided, in the event of a defect in a high current circuit breaker of the high current system, of only replacing the high current circuit breaker, at the same time ruling out any hazard to the servicing personnel carrying out the replacement.

This problem is solved through a safety system according to the description herein and the claims. A plug connector system equipped with such a safety system and an electrical system equipped with such a plug connector system represent the subject matter of the present invention described herein. Advantageous embodiments of the safety system according to the invention, of the plug connector system according to the invention and of the electrical system according to the invention are the subject matter of the various claims and are explained in the following description of the invention.

The above and other objects, which will be apparent to those skilled in the art, are achieved in the present invention which is directed to a safety system for high current applications comprising a high current circuit breaker and a housing enclosing the high current circuit breaker, wherein the housing forms a plug connector for electrical contact and mechanical connection to a mating plug connector, wherein the plug connector includes a coding individual to the maximum amperage protected by the high current circuit breaker, such that the plug connector includes at least two high current contact elements and at least two low current contact elements.

The housing includes the high current circuit breaker in permanently closed manner, and may include a shield.

In a second aspect, the present invention is directed to a plug connector system with a safety system for high current applications, the safety system comprising a high current circuit breaker and a housing enclosing the high current circuit breaker, wherein the housing forms a plug connector for electrical contact and mechanical connection to a mating plug connector, wherein the plug connector includes a coding individual to the maximum amperage protected by the high current circuit breaker, such that the plug connector includes at least two high current contact elements and at least two low current contact elements, and a mating plug connector complementary to the plug connector of the safety system.

The plugged connection between the plug connector and the mating plug connector may be watertight.

The plug connector and the mating plug connector are designed such that, on being plugged together, the high current contact elements of the plug connector and mating plug connector make contact first, followed by the low current contact elements thereof.

The mating plug connector includes protection against contact for the high current contact elements and/or the low current contacts, in the unplugged state of the plug connector system, the protection satisfying class IP1X (IP—Ingress Protection) for protection against access with the back of the hand, class IP2X for protection against access with a finger, class IP3X for protection against access with a tool, class IP4X for protection against access with a wire, class IP5X for complete protection against contact, or class IP6X, for complete protection against contact.

The protection against contact is designed according to DIN EN 60529 in the German version EN 60529:1991+A1: 2000.

In a third aspect, the present invention is directed to an electrical system with an electrical energy source, an electrical consumer, and a cabling system which connects the energy source and the consumer in an electrically conducting manner, wherein the cabling system includes at least one plug connector system with a safety system for high current applications, the safety system comprising a high current circuit breaker and a housing enclosing the high current circuit breaker, wherein the housing forms a plug connector for electrical contact and mechanical connection to a mating plug connector, wherein the plug connector includes a coding individual to the maximum amperage protected by the high current circuit breaker, such that the plug connector includes at least two high current contact elements and at least two low current contact elements, and a mating plug connector complementary to the plug connector of the safety system.

At least one cable of the cabling system is integrated in the cabling system by a plug connector unit, wherein the plug connector unit of the cable corresponds to the plug connector system in terms of the plug interface with the exception of individual codings.

The safety system of the plug connector system serves as a maintenance disconnect, so that when the safety system is disconnected from the mating plug connector the electrical system is disconnected from the power supply.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
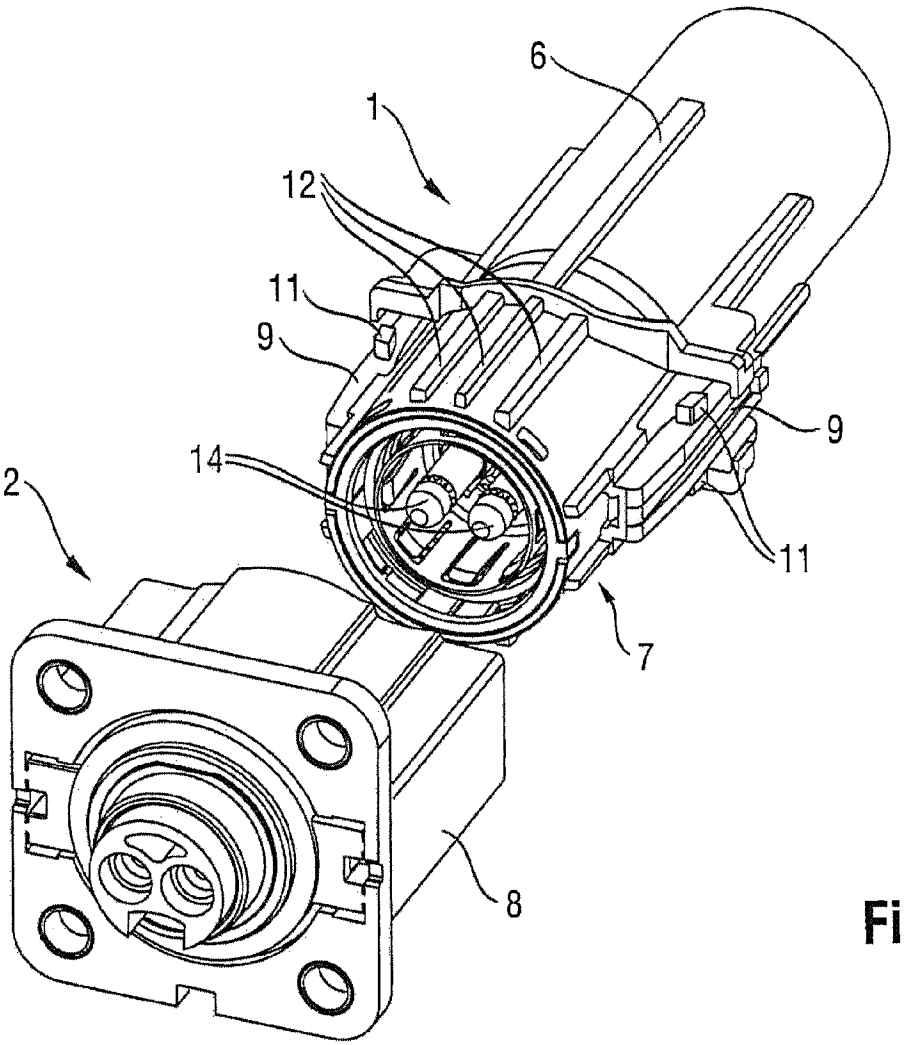
FIG. 1 shows a first isometric view of a plug connector system according to the invention with a safety system and a mating plug connector in its unplugged state.
Figure 2:
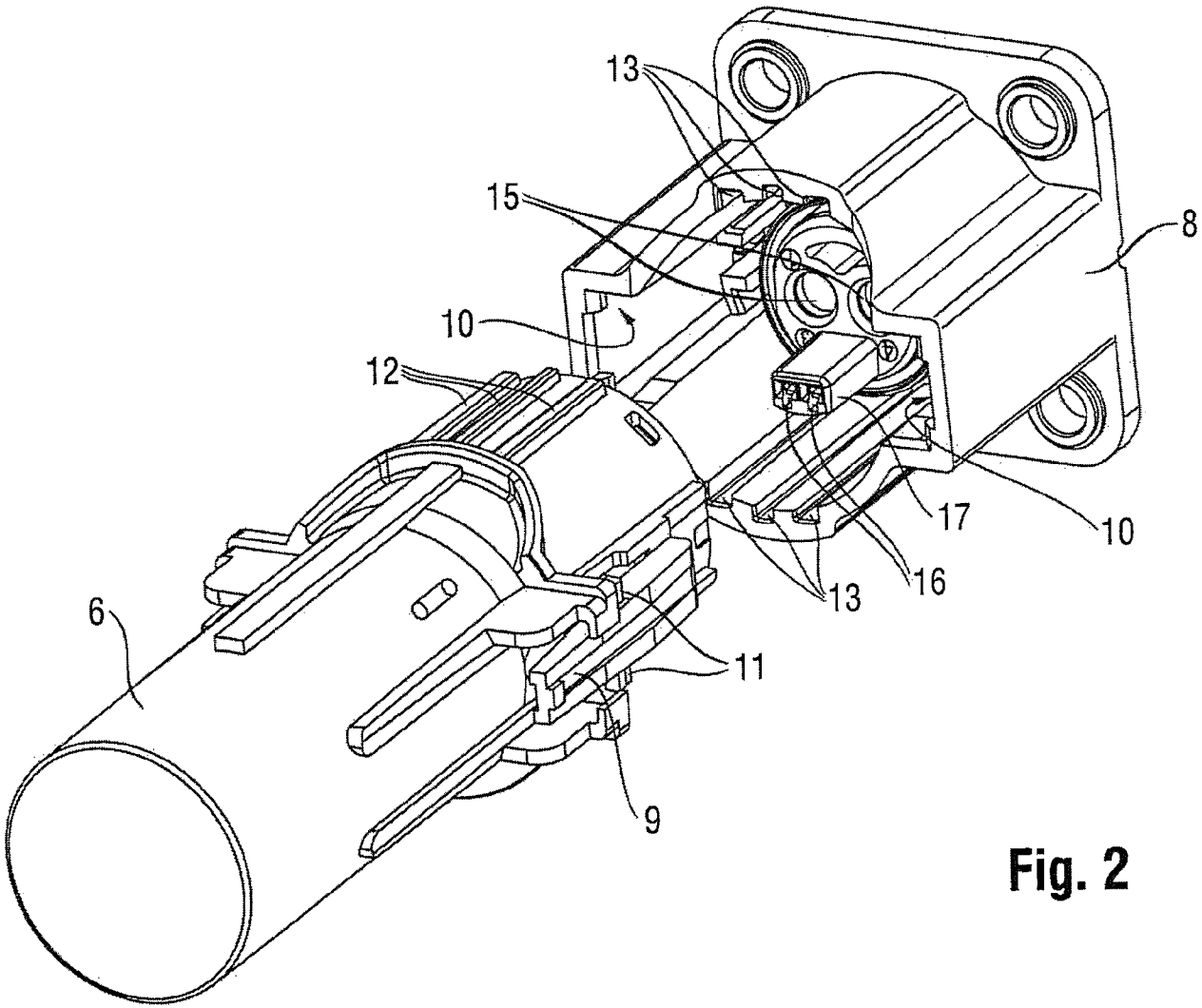
FIG. 2 shows a second isometric view of the plug connector system according to FIG. 1 in its unplugged state.
Figure 3:
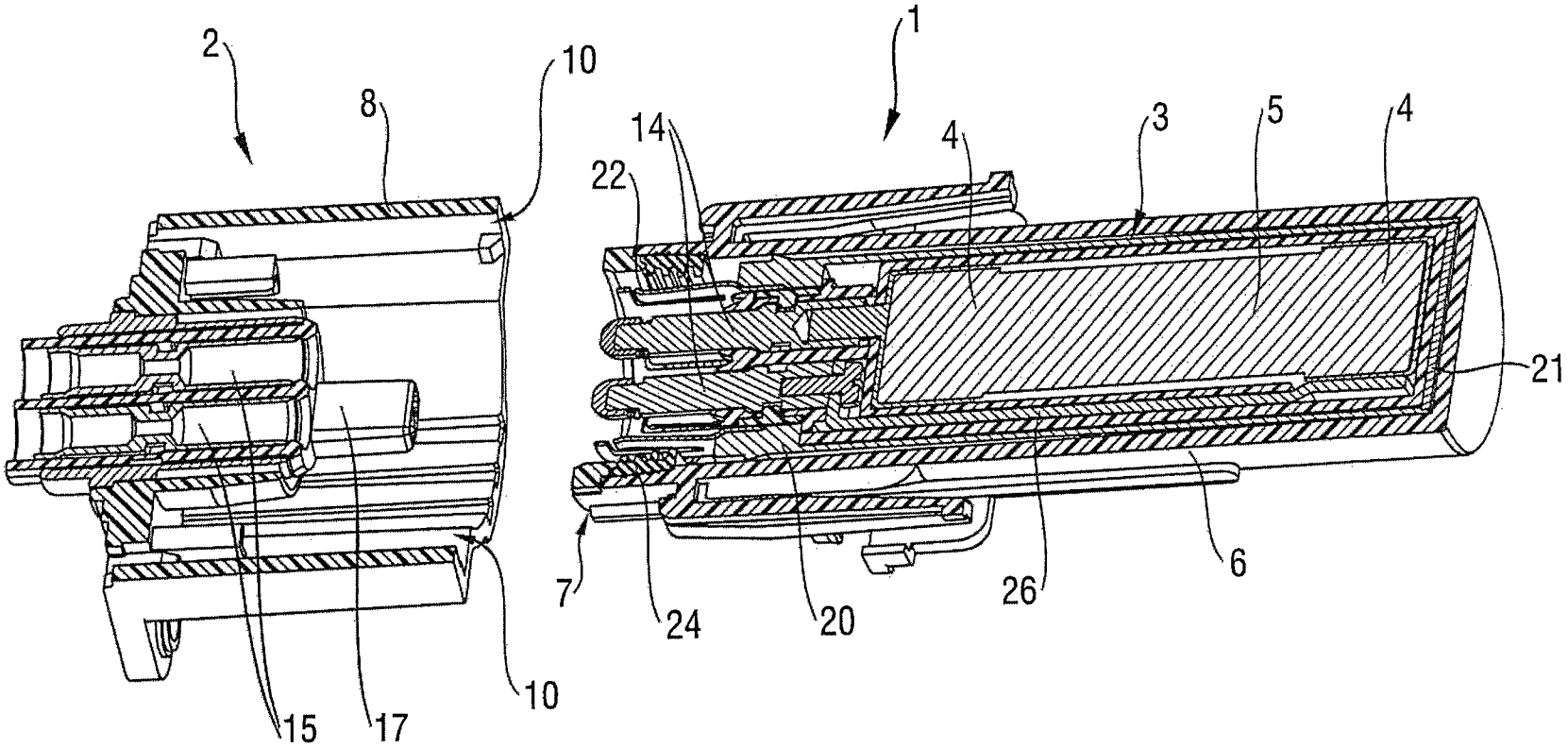
FIG. 3 shows the plug connector system according to FIGS. 1 and 2 in its unplugged state in a longitudinal section.
Figure 4:
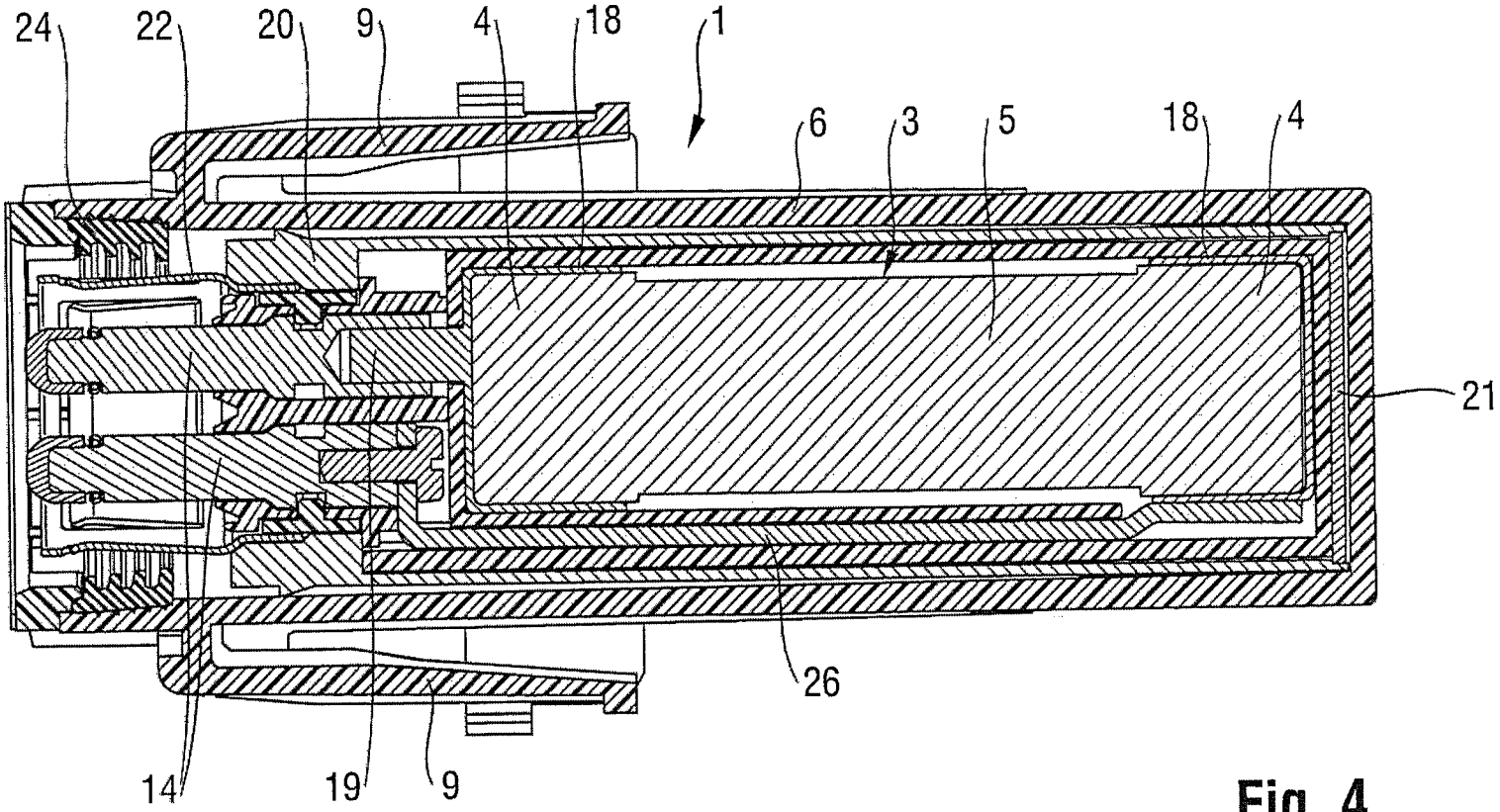
FIG. 4 shows the longitudinal section according to FIG. 3 through the insulated safety system of the plug connector system.
Figure 5:
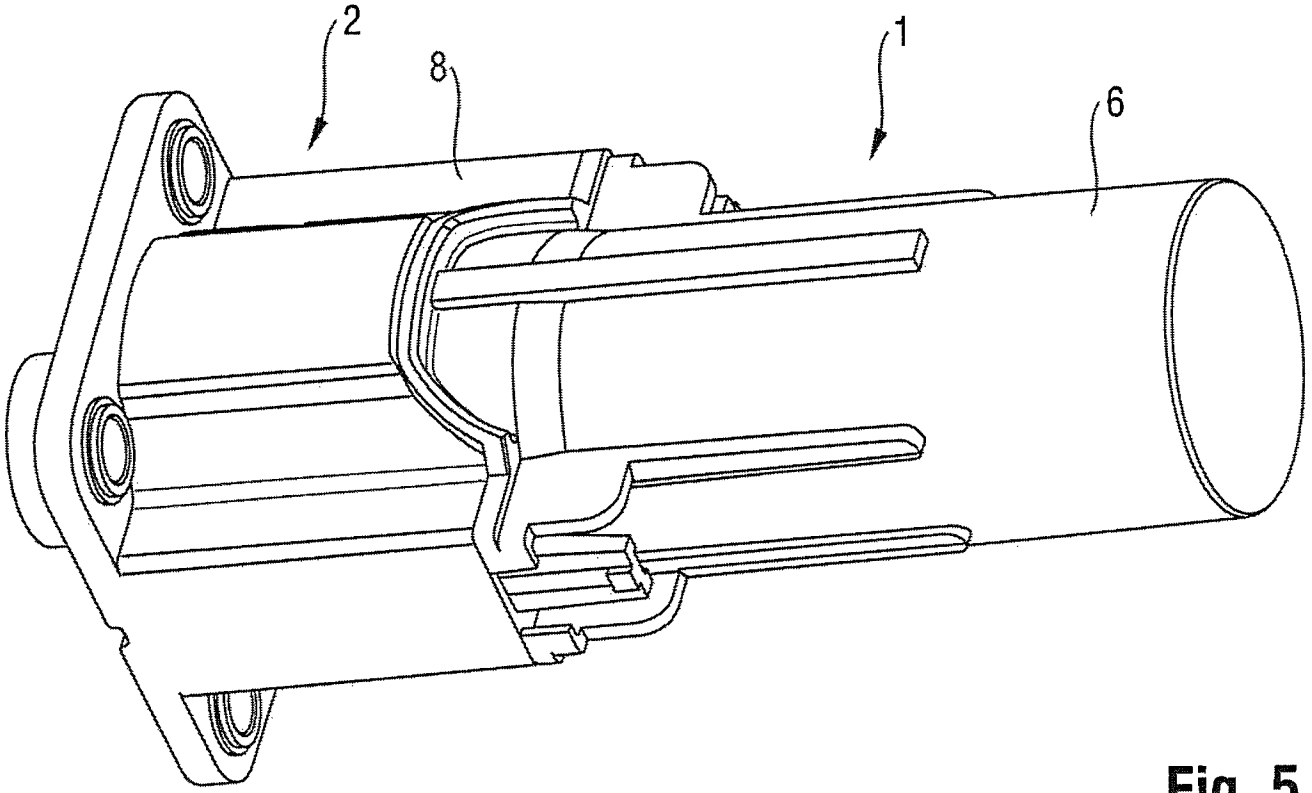
FIG. 5 shows an isometric view of the plug connector system according to FIGS. 1-4 in its plugged-together state.
Figure 6:
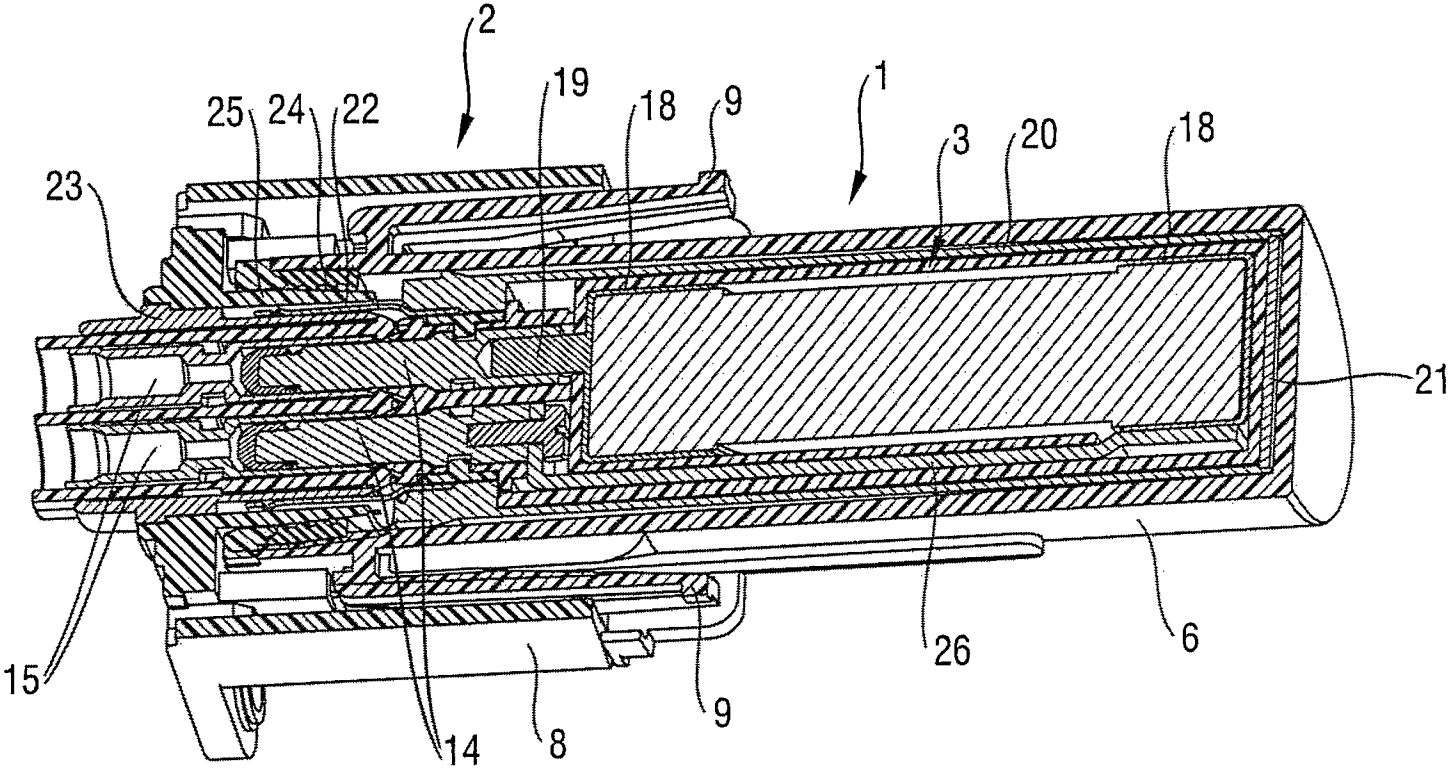
FIG. 6 shows the plug connector system according to FIGS. 1-5 in its plugged-together state in a longitudinal section.

In describing the preferred embodiment of the present invention, reference will be made herein to FIGS. 1-6 of the drawings in which like numerals refer to like features of the invention.

A safety system for high current applications according to the invention comprises a high current circuit breaker and an electrically insulating housing enclosing the high current circuit breaker, wherein the housing forms a plug connector for electrical contact and for mechanical connection to a mating plug connector.

The integration of the high current circuit breaker in the electrically insulating housing makes it possible to avoid a hazard resulting from contact with the electrically conducting elements of the high current circuit breaker. The fact that the housing can form a plug connector for electrical contact and mechanical connection with a mating plug connector makes it possible to integrate the high current circuit breaker quickly and simply in an electrical (high current) system.

In addition to a safety system according to the invention, a plug connector system according to the invention also comprises at least one mating plug connector complementary to the plug connector of the safety system.

An electrical system according to the invention comprises an electrical (high current) energy source, an electrical (high current) consumer and a cabling system which connects the energy source and the consumer in an electrically conducting manner, wherein the cabling system comprises at least one plug connector system according to the invention.

Preferably, the housing of the safety system can be permanently sealed, i.e., such that it is not possible to open the housing without damaging it. This ensures that it is not possible to remove or replace the high current circuit breaker integrated in the housing.

This is, in particular, advantageous, if—as provided for in a preferred embodiment—the plug connector of the housing is provided with a coding which is individual in design, at least with respect to the amperage protected by the high current circuit breaker. Accordingly, a coding of the plug connector for a safety system integrating a high current circuit breaker which protects amperage of up to 20 A can for example be different in design to one for a safety system in which the high current circuit breaker protects amperage of up to 40 A. Through the individual coding, it can thus be ensured that a defective safety system with a blown high current circuit breaker can only be replaced with a safety system with a high current circuit breaker protecting the same current rating. The coding can in particular be in the form of one or more individually formed projections or recesses which interact with corresponding complementary recesses/projections on the mating plug connector. In addition, or alternatively, a color coding may also be provided.

Not only can the coding of the safety system according to the invention or of the plug connector system according to the invention be individual in design in relation to the protected amperage, in addition, or alternatively, the codings which are provided for safety systems according to the invention in an electrical system according to the invention can differ from codings of other plug connector units used in the electrical system. This can in particular be practical if—as is preferably the case—the plug interface of the plug connector system according to the invention corresponds—with the exception of the coding—with the plug interface of the other plug connector units of the electrical system. In particular, in an electrical system according to the invention, the cables of the cabling system connecting the energy source and the consumer can be connected by corresponding plug connector units. The uses of preferably identical plug connectors throughout the electrical system can help keep down the manufacturing costs for the electrical system.

In a further preferred embodiment of the safety system according to the invention, the housing can include a shield which encloses (at least) the high current circuit breaker (preferably completely). The shield is intended to prevent the coupling in or out of electromagnetic fields.

In an advantageous embodiment of the electrical system according to the invention, the safety system of the plug connector system can serve as a maintenance disconnect, so that when the safety system is disconnected from the electrical system, the electrical system is (at least in part) disconnected from the power supply. Accordingly, before carrying out maintenance or repairs on the electrical system, only the safety system integrated in the electrical system via a plugged connection needs to be removed, as a result of which the entire electrical system is, if necessary, disconnected from the power supply.

For this purpose, it can preferably be the case that, in addition to (at least) two high current contact elements connected in an electrically conducting manner with the high current circuit breaker, the plug connector of the safety system according to the invention and the mating plug connector of the plug connector system according to the invention possess a further (at least) two (low current) contact elements. In the plugged-together state of the plug connector system according to the invention, the low current contact elements can represent a section of a low current circuit. An interruption of the low current circuit as a result of the safety system being unplugged from the mating plug connector can lead to the energy source of the electrical system according to the invention being cut off.

Preferably, the high current contact elements and the low current contact elements can be so designed or integrated in the safety system and the mating plug connector that when the plug connector and mating plug connector are plugged together, first the high current contact elements and then the low current contact elements of the plug connector and mating plug connector make contact. Conversely, when the plug connector and mating plug connector are unplugged, the contact between the low current contact elements is first broken, followed by that between the high current contact elements. This ensures that at the time the high current contact elements of the plug connector and mating plug connector make contact or break contact, these are not carrying any high voltage. This prevents, in particular, an electric spark-over between high current contact elements which have not yet made contact, or have not yet made contact completely.

A high level of safety with corresponding protection of operating or servicing personnel against accidental contact with electrical high voltage is achieved in that the mating plug connector is designed with protection against contact for the high current contact elements and/or the low current contacts, in the unplugged state of the plug connector system, of class IP1X, i.e., protected against access with the back of the hand, class IP2X, i.e., protected against access with a finger, class IP3X, i.e., protected against access with a tool, class IP4X, i.e., protected against access with a wire, class IP5X, i.e., complete protection against contact, or class IP6X, i.e., complete protection against contact. The protection against contact is preferably provided in compliance with DIN EN 60529 in the German version EN 60529: 1991+A1:2000.

In a further preferred embodiment of the plug connector system according to the invention, the plugged connection between the plug connector and mating plug connector is watertight in design. For example, one or more sealing elements can be provided for this purpose.

An embodiment of a plug connector system according to the invention is shown in the drawings. This comprises a safety system 1 according to the invention as well as a complementary mating plug connector 2. The mating plug connector 2 is intended to be fixed in place on a component. For this purpose, through-openings are provided by means of which the component can, for example, be screwed together with the mating plug connector. The mating plug connector 2 can also be designed as an angled plug connector.

The safety system 1 comprises a high current circuit breaker 3 with a substantially conventional structure. Arranged between two end-side cylindrical contact elements 4 is a fuse body 5 which fails when a level of the current carried by the high current circuit breaker 3 exceeds the maximal protected amperage and as a result interrupts the electric circuit in which the high current circuit breaker 3 is integrated. For use in the electric-powered drivetrain of a motor vehicle, the level of the maximum amperage protected through the high current circuit breaker 3 can, for example, amount to either 20 A, 40 A, or 60 A, depending on the location of use.

The safety system 1 further comprises a housing 6 made of an electrically insulating plastic, within which the high current circuit breaker 3 is arranged. The housing 6 forms at one end a plug connector which can be electrically contacted and mechanically connected with the mating plug connector 2 of the plug connector system by plugging them together. The plug interface of the plug connector comprises for this purpose a hollow cylindrical section 7 of the housing 6 which can be plugged into a corresponding receiving opening of a housing 8 of the mating plug connector 2. In addition, two diagonally opposite locking clips 9 are provided on the outside of the housing 6, the plug-side ends of which are fixed to the hollow cylindrical housing section 7. When the plug connector 1 is plugged into the mating plug connector 2, the locking clips 9 are pushed into corresponding receptacles 10 of the mating plug connector 2, wherein in each case two snap lugs 11 snap behind corresponding projections within the receptacles 10. As a result, a form-locking connection, acting in a disconnecting direction (opposite to the plugging-together direction) between the safety system 1 and the mating plug connector 2 is realized. This mechanical connection can be released again in that the free ends of the two locking clips 9 are deflected manually in the direction of the housing 6, as a result of which the snap lugs 11 are released from their engagement behind the projections in the receptacles 10. By applying a tensile force to the safety system 1, this can then be unplugged from the mating plug connector 2.

A plurality of projections 12 extending in the plugging-together direction are provided on the outside of the hollow cylindrical housing section 7. In the plugged-together state of the plug connector system, these engage in complementary recesses 13 on the inner side of the housing 8 of the mating plug connector 2. The projections 12 in combination with the recesses 13 serve as a coding by means of which it is ensured that, on the one hand, the safety system 1 can only be plugged into the mating plug connector 2 in one orientation, and, on the other hand, that it is only possible to fit one particular version of the safety system 1 into the mating plug connector 2. The different versions of the safety system 1 only differ—apart from the coding—in the level of the maximum amperage protected by the high current circuit breaker 3. Through the coding of safety system 1 and mating plug connector 2 it is thus ensured that a safety system 1 with a blown high current circuit breaker 3 can only be replaced with a safety system 1 with the same maximum protected amperage.

The plug interface of the plug connector also comprises two high current contact elements 14, electrically isolated from one another, in the form of contact pins which, when the plug connector system is plugged together, are plugged into complementary high current contact elements 15 (electrically isolated from one another) in the form of contact sockets of the mating plug connector 2, making electrically conducting contact with these. As a result, the high current circuit breaker is integrated in a (high current) electric circuit in order to protect this against overcurrent. This can, for example, be an electric circuit via which an electrical drive motor of a motor vehicle is supplied with energy from a battery.

The plug interface of the plug connector also comprises two low current contact elements in the form of contact pins which, when the plug connector system is plugged together, plug into in complementary low current contact elements 16 in the form of contact sockets of the mating plug connector, making electrically conducting contact with these. The contact sockets are arranged in a socket housing 17 of the mating plug connector 2. The function of the low current contact elements of the plug connector system is fundamentally that of a switch, wherein a (low voltage) electric circuit operated with low voltage (for example 12 V) is closed when the plug connector system is plugged together, and this is interrupted by unplugging the safety system 1 from the mating plug connector 2. The low current circuit can be connected with a control device which interrupts the high current circuit in the event of an interruption of the low current circuit, wherein this preferably takes place such that as many components of the high current circuit as possible—including the high current contact elements 16 of the mating plug connector—are free of voltage.

The electrically conducting connection between the high current contact elements 14, 15 of the safety system 1 and the two end-side cylindrical contact elements 4 of the high current circuit breaker takes place, in the case of the proximally arranged contact element 4, via a contact element, designed as a spring bush 18, which encloses the contact element 4 of the high current circuit breaker 3. Attached to the spring bush 18 is a contact pin 19 which engages in a socket-formed receptacle of the associated high current contact element 14. A contact element designed as a spring bush 18 which embraces the contact element 4 of the high current circuit breaker 3 is also used for the electrically conducting connection of the distally arranged contact element 4 of the high current circuit breaker with the associated high current contact element 14 of the safety system 1. Laterally contacting this spring bush 18 is a section of a conductor rail 26 which extends as far as the associated high current contact element 14 and is screwed together with this.

Also integrated in the plug connector system is a shield which is intended to prevent the coupling in or out of electromagnetic fields. For this purpose, the safety system 1 has, within the housing 6, a first external conductor 20 (made of an electrically conducting material) which surrounds the high current circuit breaker 3 and a section of the high current contact element 14, but is electrically isolated from this. On the end opposite the plug-side end, the first external conductor 20 is closed by means of a cap 21, also made of electrically conducting material. On the plug-side end, the first external conductor 20 radially contacts a second external conductor 22 which is designed in the form of a spring bush. In the plugged-together state of the plug connector system, an electrically conducting connection with a (third) external conductor 23 is realized via this spring bush which, within the housing 8 of the mating plug connector 2, encloses the high current contact elements 15 therein, but is electrically isolated from these.

In the region of the plug-side end of the safety system 1, a ring-formed sealing element 24 is provided on the inner side of the housing 6 which, when the safety system 1 and mating plug connector 2 are plugged together, is pushed onto an outer surface of a ring-formed extension 25 of the mating plug connector 2, wherein the sealing element 24 is radially deformed in order to achieve the desired sealing effect. By means of the sealing element 24, a contact space formed by the housings 6, 8 of the safety system 1 and mating plug connector 2 accommodating the high current contact elements 14, 15 and the low current contact elements 16 is sealed against the environment in order, in particular, to prevent a penetration of moisture.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A safety system for high current applications comprising a high current circuit fuse and a housing enclosing the high current circuit fuse, wherein the housing forms at one end one plug connector for electrical contact and mechanical connection to a mating plug connector, the one plug connector includes at least two high current contact elements and at least two low current contact elements, wherein a plug interface of the plug connector comprises a hollow cylindrical section of the housing which can be plugged into a corresponding receiving opening of a housing of the mating plug connector, wherein a plurality of projections extending in the plugging-together direction are provided on the outside of the hollow cylindrical housing section, wherein the projections serve as a coding by which it is ensured that, on the one hand, the safety system can only be plugged into the mating plug connector in one orientation, and on the other hand, that only a particular plug interface of the plug connector fits into the mating plug connector.

2. The safety system of claim 1 wherein the housing includes the high current circuit fuse in permanently closed manner.

3. The safety system of claim 1 wherein the housing includes a shield.

4. A plug connector system with a safety system according to claim 1, and a mating plug connector complementary to the plug connector of the safety system.

5. The plug connector system of claim 4, wherein the plugged connection between the plug connector and the mating plug connector is watertight.

6. The plug connector system of claim 4, wherein the plug connector and the mating plug connector are designed such that, on being plugged together, the high current contact elements of the plug connector and mating plug connector make contact first, followed by the low current contact elements thereof.

7. The plug connector system of claim 4, wherein the mating plug connector includes protection against contact for the high current contact elements and/or the low current contacts, in the unplugged state of the plug connector system, said protection satisfying class IP1X (IP—Ingress Protection) for protection against access with the back of the hand, class IP2X for protection against access with a finger, class IP3X for protection against access with a tool, class IP4X for protection against access with a wire, class IP5X for complete protection against contact, or class IP6X, for complete protection against contact.

8. The plug connector system of claim 7, wherein the protection against contact is designed according to DIN EN 60529 in the German version EN 60529:1991+A1:2000.

9. An electrical system with an electrical energy source, an electrical consumer, and a cabling system which connects the energy source and the consumer in an electrically conducting manner, wherein the cabling system includes at least one plug connector system according to claim 4.

10. The electrical system of claim 9, wherein at least one cable of the cabling system is integrated in the cabling system by a plug connector unit, wherein the plug connector unit of the cable corresponds to the plug connector system in terms of the plug interface with the exception of individual codings.

11. The electrical system of claim 10, wherein the safety system of the plug connector system serves as a maintenance disconnect, so that when the safety system is disconnected from the mating plug connector the electrical system is disconnected from the power supply.

12. The safety system of claim 2 wherein the housing includes a shield.

13. The plug connector system of claim 5, wherein the plug connector and the mating plug connector are designed such that, on being plugged together, the high current contact elements of the plug connector and mating plug connector make contact first, followed by the low current contact elements thereof.

14. The plug connector system of claim 6, wherein the mating plug connector includes protection against contact for the high current contact elements and/or the low current contacts, in the unplugged state of the plug connector system, said protection satisfying class IP1X (IP—Ingress Protection) for protection against access with the back of the hand, class IP2X for protection against access with a finger, class IP3X for protection against access with a tool, class IP4X for protection against access with a wire, class IP5X for complete protection against contact, or class IP6X, for complete protection against contact.

15. An electrical system with an electrical energy source, an electrical consumer, and a cabling system which connects the energy source and the consumer in an electrically conducting manner, wherein the cabling system includes at least one plug connector system according to claim 14.

* * * * *